United States Patent [19]

Christopher

[11] 4,157,129

[45] Jun. 5, 1979

[54] STABBING BOARD ASSEMBLY

[76] Inventor: Gordon W. Christopher, P.O. Box 826, Odessa, Tex. 79760

[21] Appl. No.: 900,301

[22] Filed: Apr. 26, 1978

[51] Int. Cl.[2] ..... E04G 3/10; E04G 3/14

[52] U.S. Cl. ..... 182/82; 182/148; 182/114; 414/22

[58] Field of Search ..... 182/82, 148, 141, 114, 182/223, 62.5; 187/2, 6, 9 R; 214/2.5

[56] References Cited

U.S. PATENT DOCUMENTS

| | | | |
|---|---|---|---|
| 2,076,810 | 4/1937 | Deckard | 182/82 |
| 2,425,302 | 8/1947 | Calhoun | 182/82 |
| 2,570,076 | 10/1951 | Sims | 182/223 |
| 3,023,831 | 3/1962 | Bevis | 182/82 |
| 3,061,041 | 10/1962 | Taylor | 182/129 |
| 3,596,735 | 8/1971 | Denier | 182/148 |

*Primary Examiner*—Reinaldo P. Machado
*Attorney, Agent, or Firm*—Dennison, Dennison, Meserole & Pollack

[57] ABSTRACT

A stabbing board assembly comprising a support platform mounted for powered vertical adjustment on a pair of laterally spaced vertical rails which are in turn fixed, preferably releasably, to structural members of a derrick by upper and lower sets of longitudinally adjustable mounting arms. The platform in turn includes a section slidably engaged therewith and power controlled for selective extension and retraction.

3 Claims, 7 Drawing Figures

STABBING BOARD ASSEMBLY

BACKGROUND OF THE INVENTION

The present invention generally relates to oil well derricks, and is more particularly concerned with a stabbing board assembly mountable, preferably, as a temporary installation on a well derrick.

It is a common expedient in the well art to provide some form of support or platform for accommodating a derrick man at a position well above the floor of the derrick, particularly during a running of the casing pipe into the well, in order to assist in properly axially aligning the casing pipe during the stabbing operation. Attention is directed to the following patents as constituting the most pertinent prior patent art known:

| U.S. Pat. No. | Inventor | Issued |
|---|---|---|
| 2,191,643 | Deckard | February 27, 1940 |
| 2,257,520 | York | September 30, 1941 |
| 2,291,055 | Ortloff | July 28, 1942 |
| 2,328,925 | Scott | September 7, 1943 |
| 2,345,253 | Funk | March 28, 1944 |
| 2,358,755 | Woody et al | September 19, 1944 |
| 2,662,797 | Moon | December 15, 1953 |
| 2,885,096 | DeJarnett | May 5, 1959 |
| 3,752,263 | Thevenot | August 14, 1973 |
| 3,799,364 | Kelly et al | March 26, 1974 |
| 3,976,207 | Schultz | August 24, 1976 |

These patents all are considered of interest in setting forth the general environment of the present invention and disclosing a variety of different forms of support platforms or boards heretofore utilized in providing an elevated work surface for a derrick man. Such platforms are intented to provide ready access to the casing pipe as the pipe is manipulated, normally from a storage position, to axial alignment with previously positioned sections within the well bore. In each instance, the known platforms leave much to be desired with regard to adaptability to existing derricks including, in particular, an inability to mount temporarily at substantially any point along the height of the derrick and at the same time to accommodate itself after mounting, through both vertical and horizontal adjustment means, to precisely position the derrick man.

SUMMARY OF THE INVENTION

In light of the foregoing, it is a primary purpose of the invention to provide a support system or stabbing board assembly which constitutes a significant improvement over what has heretofore been considered to constitute the State-of-the-Art.

Basically, the stabbing board assembly of the present invention, while capable of permanent attachment to a derrick structure, is primarily intended as a removable unit capable of mounting on the derrick at substantially any vertical position therealong, and in a manner so as to provide the associated platform directed inwardly toward the interior of the derrick. The assembly incorporates laterally spaced vertical rails along which the platform can be power adjusted, the platform itself including a section capable of being power extended and retracted, under the control of the supported derrick man, so as to provide a high degree of accommodation to the work being undertaken. The mounting of the vertical rails is in turn effected utilizing a plurality of support arms individually capable of longitudinal adjustment for enabling a positioning of the rails so as to maintain a vertical orientation thereof, notwithstanding angular variations in the frameworks of the various derricks on which the assembly may be mounted. Other features contributing to the structural and functional uniqueness of the assembly include the provision of a winch mounted safety cable and telescopic guard rails associated with the extendable and retractable platform section.

DESCRIPTION OF THE PREFERRED EMBODIMENT

Figure 1:
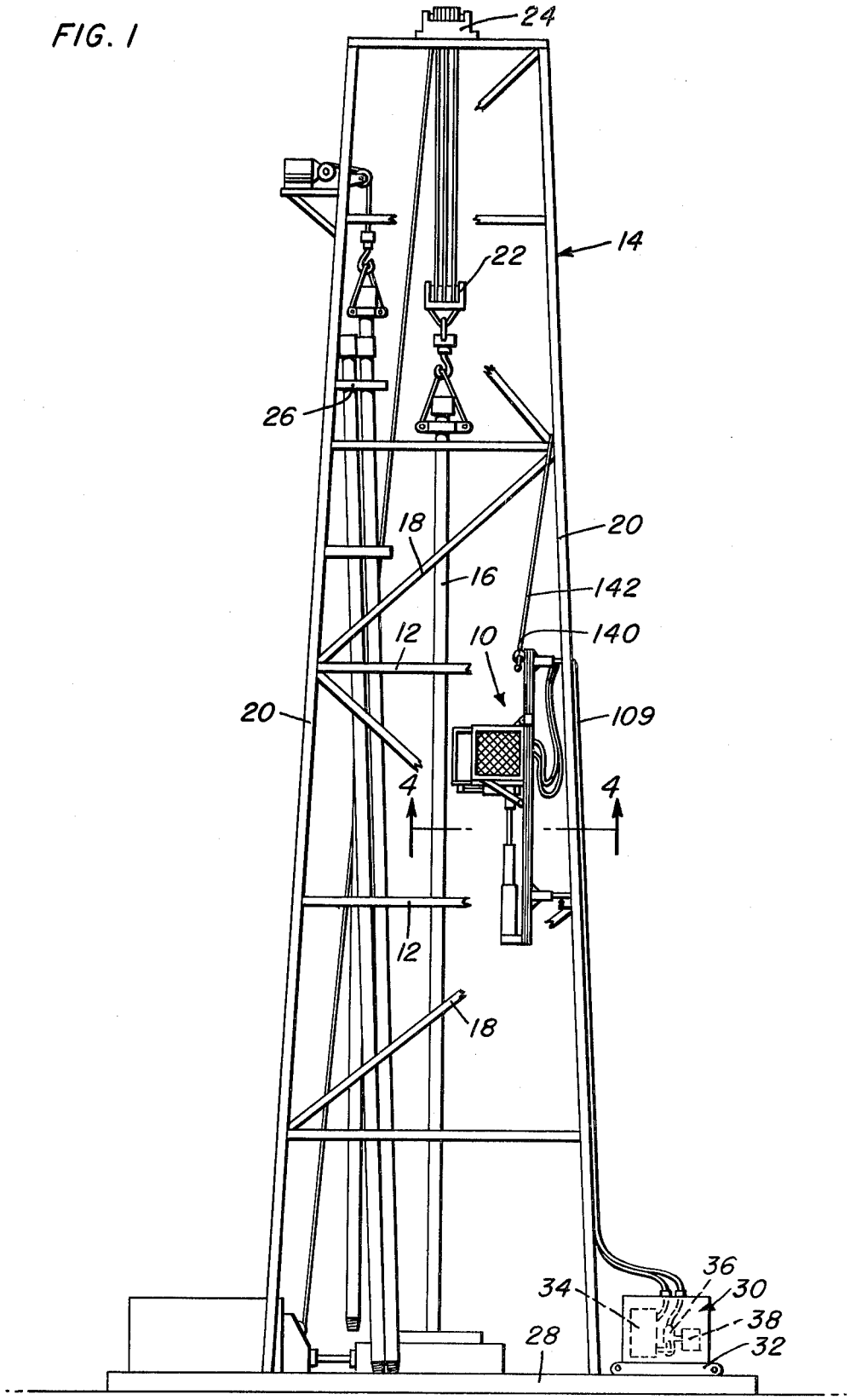
FIG. 1 is an elevational view, with portions broken away, of a derrick with the stabbing board assembly of the present invention mounted thereon.

Referring now more specifically to the drawings, attention is directed initially to FIG. 1 wherein the stabbing board assembly 10 is illustrated in the environment of normal use. Basically, the assembly 10 will mount on a pair of vertically spaced girts or cross beams 12 of a well derrick 14 in a manner so as to project interiorly thereof for the positioning of a derrick man adjacent the pipe 16 as it is moved into axial alignment with the well hole and previously positioned pipe string.

FIG. 1, in a generally schematic manner, illustrates a basic derrick structure including, in addition to the girts 12, cross braces 18, corner posts or legs 20, a travelling block 22 suspended from a crown block 24, and a pipe storage section or rack 26.

The stabbing board assembly 10, normally mounted substantially above the derrick deck 28, will have a power supply unit 30 provided on the deck 28. This unit 30 preferably will be self-contained and mounted on its own transporting base 32. It is contemplated that the power components on the assembly 10, to be described subsequently, will be hydraulically operated, and as such, the power unit 30 will incorporate an appropriate fluid reservoir 34, pump 36 and motor 38, either electric or gas powered.

The stabbing board assembly 10 is intended to be a self-contained unit in that, after positioning on the derrick structure, control of the means for both substantial vertical and horizontal adjustment is effected from the assembly itself.

The basic support components of the assembly 10 include a pair of vertically elongated, laterally spaced H-beam rails 40, each including front and rear planar faces 42 and 44, and opposed track forming side channels 46. The upper and lower ends of the rails 40 are interconnected by rigid transverse beams 48 and 50, and appropriate lifting eyes 52 are affixed to the opposite ends of the rails for manipulation and positioning of the entire assembly during the mounting and demounting thereof.

Figure 7:
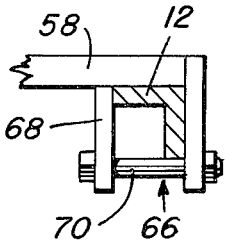
FIG. 7 is a cross sectional detail illustrating the preferred manner of releasably locking the outer end of one of the support arms to a derrick girt or cross beam.

The rail assembly mounts on the derrick structure 14, and more particularly spaced upper and lower girts 12, by means of upper and lower pairs of arms 54, one arm 54 of each pair being affixed to the rear face of each of the vertical rails 40. The arms include telescopic outer and inner sections 56 and 58 of rectangular non-rotating cross section. Each outer section 56 has the forward end thereof rigidly affixed, as by welding, to the corresponding rail 40 with appropriate stabilizing gussets 60 provided as needed. The inner section 58 is telescopically slidable within the open remote end of the outer section 56 and releasably locked in any of a plurality of adjusted positions by a locking bolt 62 extending vertically through a pair of aligned holes in the upper and lower walls of the outer section 56 and any one of a plurality of bolt passages 64 along the inner section 58 upon alignment with the bolt receiving holes within the outer section 56. The remote end of each rearwardly projecting inner section 58 includes a depending bracket 66 (note FIG. 7) which is snugly received over a derrick girt 12 for non-rotational locking thereto. The bracket 66 will normally include depending spaced parallel ears 68 along with a clamping bolt 70 extending therebetween, thus providing for a complete encircling of the girt 12 and a fixed clamping of the bracket thereto. The angular configuration of the girt, normally formed of angle-iron, and the close conformance of the bracket thereto, will provide a highly stable non-rotational locking of the arm 54 to the girt 12. The installation as described is a removable installation in the sense that the arms can be released from the girts and the entire stabbing board assembly removed for either vertical adjustment on the derrick or the use on another derrick. However, if so desired, a permanent installation can be provided by a welding or otherwise permanent affixing of the bracket ends of the arms to the girts. It is also to be appreciated that the individual longitudinal adjustability of the arms enables an accommodation of the assembly to the normally inclined structural sides of the derrick while still maintaining the proper vertical and horizontal orientation of the components of the stabbing assembly 10.

The platform 72, which supports the workman or derrick man, includes a rectangular deck 74 provided with a mesh floor affixed to and supported on a frame including a pair of forwardly opening and inwardly facing channel-shaped tracks 76 and a transverse rear bar 78. The mesh floor provides a self-cleaning traction surface. The basic platform structure 72 is completed by mesh side and rear walls 80 and 82 incorporating structural frameworks affixed to the deck 74 and projecting vertically upward therefrom. The upper rail 84 of each of the side walls 80 is in the nature of a forwardly opening hollow rectangular member.

The working area of the platform 72 is effectively enlarged and horizontally adjustable through the provision of a platform extension 86 associated with the forward end of the platform, or that end directed toward the central working area of the derrick. This platform extension includes a floor section 88, the opposed side edges of which are slidably received within the inwardly facing floor supporting channels 76 of the main platform deck 74. Projecting vertically from the forward corners of the section 88, the surface of which will also be of mesh construction, are a pair of vertical corner posts 90, interconnected at their upper end by a front bar 92. Projecting rearwardly from the upper ends of the corner posts 90 are a pair of rectangular side rails 94 which are telescopically slidable within the top side rails 84 of the main platform. In this manner, the entire platform extension 86 is capable of slidable adjustment relative to the main platform. It will of course be appreciated that the length of the extension floor section 88 and the upper associated rails 94 are such so as to provide a stable support of the extension in even its outermost extended position. In other words, a substantial length of these components will be retained within both the opposed floor receiving channels 76 and top rail receiving tubes 84 in the maximum extended position.

The actual extension and retraction of the platform extension 86 will be effected by power means, and more particularly by a double acting hydraulic ram 96 comprising, as is conventional, a hydraulic cylinder 98 and the selectively extensible piston 100.

Figure 4:
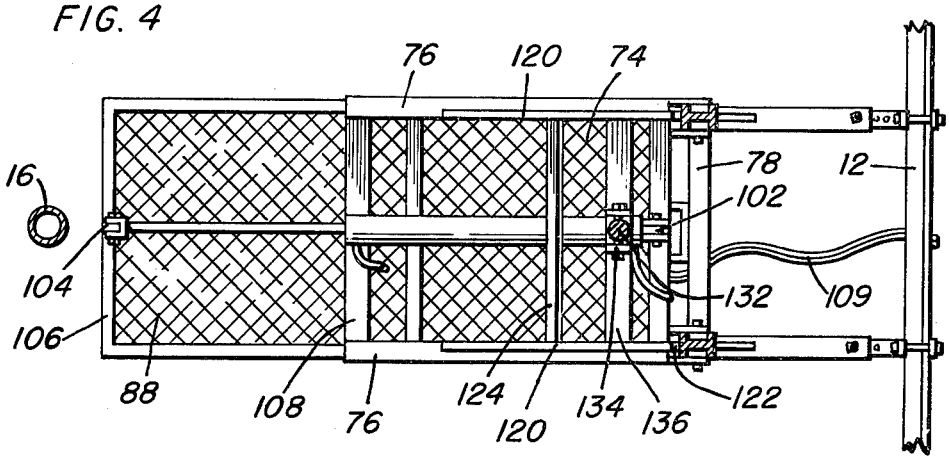
FIG. 4 is a bottom plan view, taken substantially on line 4—4 of FIG. 1, of the stabbing board assembly.

With reference to FIG. 4 in particular, it will be noted that the ram 96 will have the remote or rear end of the cylinder 98 secured to the rear portion of the platform deck 74 by means of a depending ear 102 affixed to the rear transverse floor support frame member 78. The forward or remote end of the piston 100 is in turn affixed to a depending ear 104 on a forward cross beam or frame member 106 on the extension floor section 88. FIG. 4 is of further interest in illustrating the possibility of the provision of additional cross bracing members 108 on the platform deck 74. Such members will of course be positioned so as not to interfere with the telescopic adjustment of the extension floor section 88. If deemed desirable, additional stabilizing brackets can be provided for the ram cylinder 98 which, in turn, may assist in further stabilizing the platform extension.

The hydraulic supply lines, generally indicated by reference numeral 109, will run from the power supply unit 30 through an appropriate platform mounted control 110 and to the appropriate ends of the ram cylinder 98 whereby the occupant of the stabbing board assembly will have direct control over the extension and retraction, or horizontal adjustment, of the platform.

Figure 5:
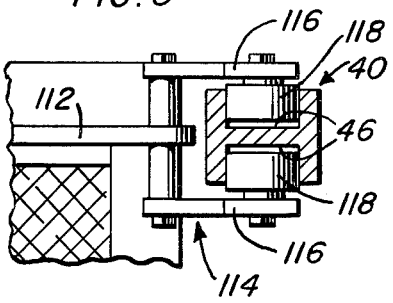
FIG. 5 is a cross sectional detail illustrating one set of upper platform rollers engaged with the corresponding vertical rail.

The main platform 72 is engaged with the vertical rails 40 for rolling vertical movement therealong. Noting FIGS. 2 and 5 in particular, a pair of diagonal side supports 112 are rigidly affixed, at the lower ends thereof, to the opposed side rails 76 and project upwardly and rearwardly therefrom to rigid engagement with upper side rails 84 of the side walls 80 and therebeyond. The upwardly rearwardly projecting end of each of these side supports 112 mounts a generally U-shaped yoke or wheel bracket 114 which in turn includes a pair of side panels 116 positioned to the opposite sides of the corresponding vertical rails 40. Each of the side panels 116 mounts upper and lower freely rotating rollers 118 received within the side channels 46 wherein they are in effect confined or trapped for rolling movement solely along the length of the rails. It will be appreciated that the wheel brackets, in addition to providing for the vertical travel of the platform along the rails 40, also effectively locks the platform to the rails for travel therealong.

Figure 2:
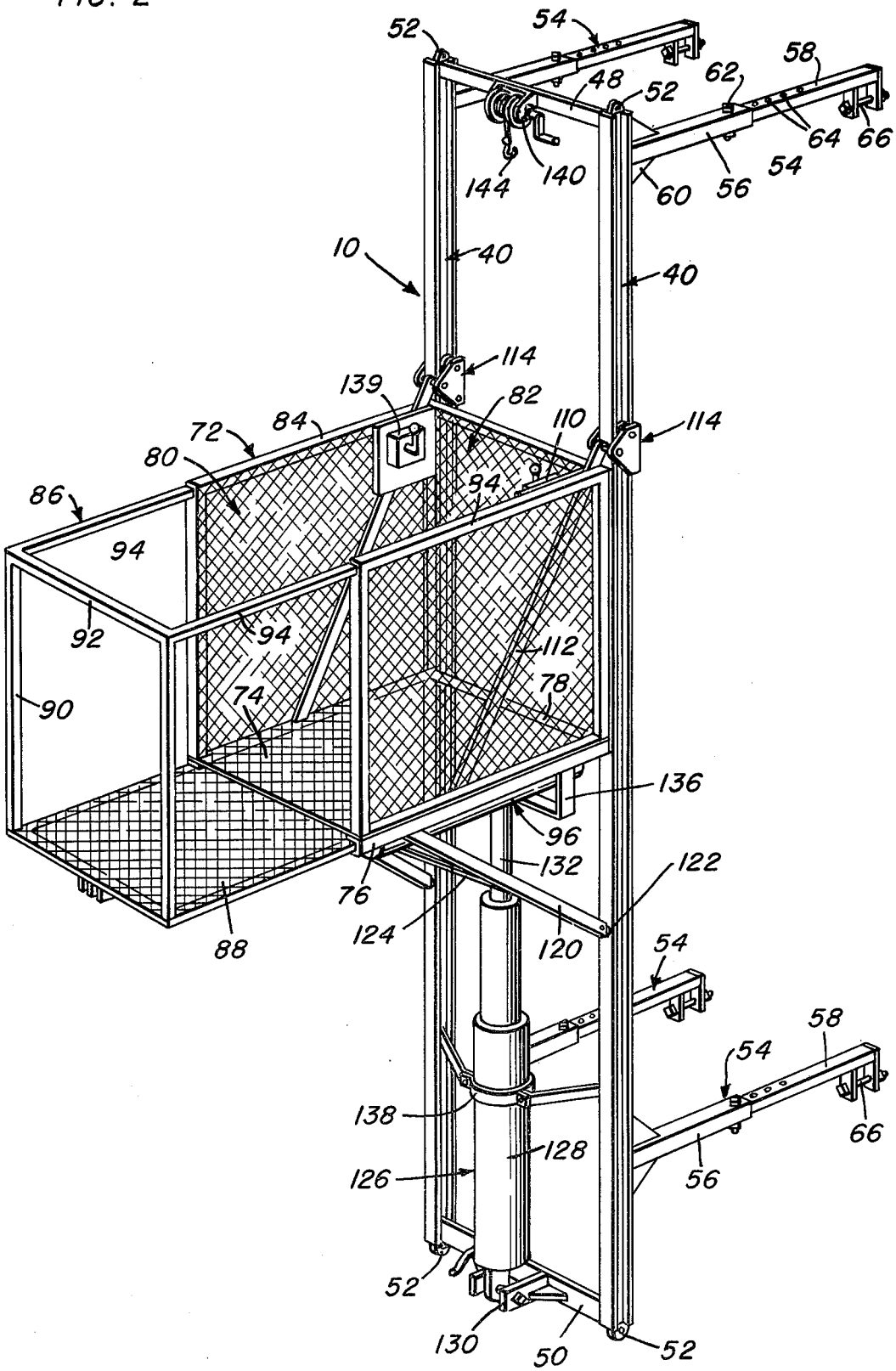
FIG. 2 is an enlarged perspective view of the stabbing board assembly per se.
Figure 3:
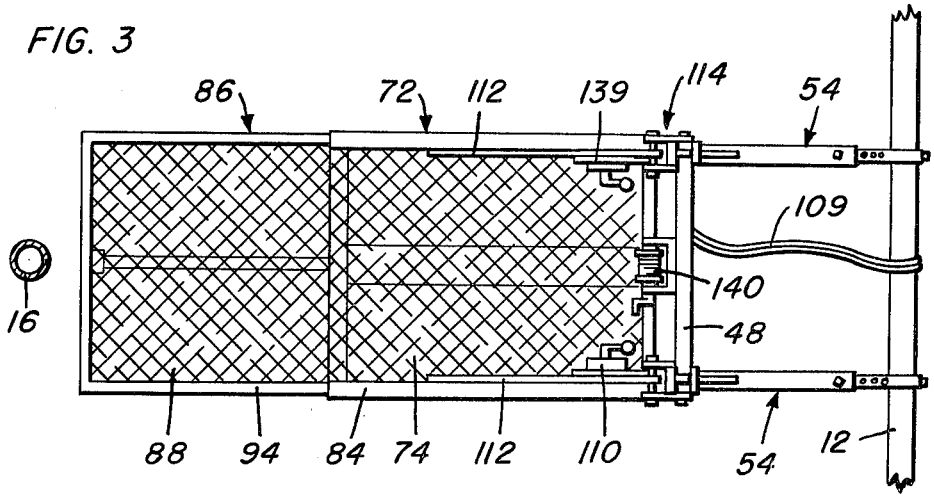
FIG. 3 is a top plan view of the mounted stabbing board assembly.
Figure 6:
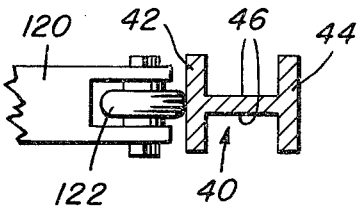
FIG. 6 is a cross sectional detail illustrating one of the lower platform rollers engaged with the face of the corresponding support rail.

With continued reference to FIG. 2, and the detail of FIG. 6, the platform assembly is further stabilized relative to the rails by a pair of downwardly and rearwardly angled support bars or braces 120 having the upper forward ends thereof rigidly affixed, as by welding, to the under-surface of the deck channels 76 and the lower rear ends thereof supporting free rotating rollers or wheels 122 which roll along the forward faces of the vertical rails 40 and both support and horizontally retain the platform. The support bars 120 can be suitably braced, for example by gussets or by, as illustrated, cross members 124.

The vertical adjustment of the platform 72 is effected by an enlarged hydraulic ram 126 vertically oriented below the platform with the lower or remote end of the cylinder 128 thereof mounted to a projecting mounting bracket 130 affixed to the cross beam 50 and with the upper or remote end of the piston 132 mounted by bracket means 134 to a rigid yoke 136 which straddles the overlying horizontal ram 96 and has the opposite ends thereof engaged with the platform deck 74 toward the rear thereof. In this manner the force applied by the vertical ram 126 will be generally close to the plane of the vertical rails 40 so as to facilitate the smooth rolling movement of the wheel supported platform therealong. As indicated in FIG. 2, appropriate saddles or brackets 138 can be provided between the lower portions of the rails 40 for a stabilization of the ram 126. As with the ram 96, hydraulic lines for ram 126 will run from the power supply unit 30 through a platform mounted control 139.

Noting FIGS. 1 and 2, the stabbing board assembly 10 of the invention is completed by the provision of a manually operated safety winch 140 upon which is wound an elongated cable 142 having a hook 144 secured to the end thereof for selective engagement over a derrick girt, or other appropriate derrick structural component, at a point above the position of the main assembly 10. The winch incorporates appropriate conventional lock means, such as a pivoted pawl and ratchet wheel, for a locking of the length of the cable 142. As will be noted, the winch is mounted on the upper cross beam 48 which interlocks the upper ends of the vertical rails 40. The winch and cable, so positioned and utilized, provides an additional safety factor for the occupant of the stabbing board assembly.

From the foregoing, it should be appreciated that the assembly described provides a unique means for the positioning of a stabbing board, or work platform, at substantially any desired position with a derrick with the assembly, once positioned, incorporating means for effecting both vertical and horizontal adjustment under the control of the occupant of the assembly. Further, while the assembly can be permanently mounted, a particularly significant feature of the assembly is its capability of being temporarily mounted where and when needed. This will, in turn, avoid the necessity of and expense involved in providing a separate assembly for association with each derrick. Notwithstanding the portable nature of the assembly, the mounted assembly is highly stable and capable, when mounted, of providing a substantial degree of occupant controlled adjustment for accommodation to individual situations and changing conditions.

The foregoing is considered illustrative of the principles of the invention and as modifications and changes may occur to those skilled in the art, it is not desired to limit the invention to the exact construction and operation shown and described. Accordingly, all suitable modifications and equivalents may be resorted to, falling within the scope of the invention as claimed.

I claim:

1. A stabbing board assembly mountable with a derrick including vertical corner posts and horizontal girts; said assembly comprising a pair of parallel laterally spaced vertical H-beam rails, each rail defining opposed side channels and a forward face, a support platform, means mounting said platform on said vertical rails and in outwardly projecting relation thereto for vertical travel of the platform along said rails, said means mounting said platform on said vertical rails comprising upper rollers rotatably mounted on said platform and rollingly locked within said opposed channels for rolling movement solely in a vertical direction relative to said rails, a pair of downwardly and rearwardly angled support bars having upper forward ends thereof rigidly affixed to the platform outward of said vertical rails, and lower rollers rotatably mounted on the lower rear ends of said bars, said lower rollers freely resting against said forward faces of said rails in vertically spaced relation below said upper rollers to support and horizontally maintain said platform, vertically acting power means engaged with said support platform for vertically adjusting said support platform along said vertical rails, said vertically acting power means comprising hydraulic ram means engaged with said vertical rails generally therebetween and below said support platform, said ram means projecting vertically into engagement with said platform, and arm means rigid with said vertical rails and projecting therefrom for engagement with selected derrick girts for the mounting of the assembly thereon, said arm means comprising upper and lower arms associated with each rail and projecting horizontally therefrom, each arm including an inner end fixed to the associated rail, each arm being longitudinally adjustable and including means for the fixing of the arms selectively in any one of a plurality of longitudinally adjusted positions, and an outer end on each arm including bracket means for selective securing of the arms to selected girts, an extensible section mounted on and selectively extensible and retractable relative to said support platform, and horizontally acting hydraulic ram means engaged between said support platform and said extensible section for a selective extension and retraction of the extensible section.

2. The assembly of claim 1 including a lockable winch secured to the upper portion of said rails, said winch mounting a cable selectively extensible therefrom into engagement with an overlying derrick component.

3. The assembly of claim 1 including upwardly extending side walls on the platform, each side wall having an upper forwardly opening tubular rail, said extension section having post supported upper side rails telescopically received within and selectively extensible and retractable relative to the tubular rails of the platform side walls in conjunction with the extension and retraction of the extension section.

* * * * *